US006012726A

United States Patent [19]

Grande et al.

[11] Patent Number: 6,012,726

[45] Date of Patent: Jan. 11, 2000

[54] IN-LINE SKATE WITH TEMPERATURE DEPENDENT SUPPORT

[75] Inventors: Dodd H. Grande, Seattle, Wash.; Antonin A. Meibock, Calgary, Canada; John E. Svensson, Vashon, Wash.

[73] Assignee: K-2 Corporation, Vashon, Wash.

[21] Appl. No.: 08/799,857

[22] Filed: Feb. 13, 1997

[51] Int. Cl.[7] ..... A63C 17/02; A43B 5/04

[52] U.S. Cl. ..... 280/11.22; 36/115

[58] Field of Search ..... 36/88, 89, 93, 36/117.6, 115; 280/11.22, 11.27, 11.19, 811

[56] References Cited

U.S. PATENT DOCUMENTS

| | | | |
|---|---|---|---|
| 4,083,127 | 4/1978 | Hanson | 36/93 |
| 4,255,202 | 3/1981 | Swan, Jr. | 106/122 |
| 4,454,871 | 6/1984 | Mann et al. . | |
| 4,502,234 | 3/1985 | Schaefer et al. . | |
| 4,724,627 | 2/1988 | Sisco | 36/119 |
| 4,808,469 | 2/1989 | Hiles . | |
| 5,027,801 | 7/1991 | Grim . | |
| 5,050,319 | 9/1991 | Perotto et al. | 36/117 |
| 5,067,257 | 11/1991 | Coomer | 36/93 |
| 5,083,910 | 1/1992 | Abshire et al. . | |
| 5,101,580 | 4/1992 | Lyden | 36/93 |
| 5,334,646 | 8/1994 | Chen . | |
| 5,430,961 | 7/1995 | Faulconer | 36/93 |
| 5,437,466 | 8/1995 | Meibock et al. . | |
| 5,449,005 | 9/1995 | Echols | 128/882 |
| 5,765,298 | 6/1998 | Potter | 36/89 |

FOREIGN PATENT DOCUMENTS

| | | |
|---|---|---|
| WO 96/28056 | 9/1996 | WIPO . |
| WO 96/28057 | 9/1996 | WIPO . |

OTHER PUBLICATIONS

"Separations." Brochure published by Gel Sciences, Inc., Waltham, MA., published prior to Feb. 13, 1997.

"Gels." Brochure published by Gel Sciences, Inc., Waltham, MA., published prior to Feb. 13, 1997.

Catherine Fahy, "Smart gels on horizon," published prior to Feb. 13, 1977.

"One Giant Step for Gels," *Business Week*, Sep. 18, 1995.

"Polymer Gels Get Smarter," *Science* 259 (Feb. 12, 1993): 893.

Barrett, R., "Gel Sciences Inc: Cooking Up Smart Blobs for All Uses," *Technology Transfer*, published prior to Feb. 13, 1997, p. 75.

Diggs, D., "Responsive Hydrogels for Separations" (Gel Sciences, Inc.), published prior to Feb. 13, 1997.

"Conformable Gel Shoe Insert" (Gel Sciences, Inc., Bedford, MA), published prior to Feb. 13, 1997.

*Primary Examiner*—Lanna Mai
*Assistant Examiner*—Jeff Restifo
*Attorney, Agent, or Firm*—Christensen, O'Connor, Johnson & Kindness PLLC

[57] ABSTRACT

An in-line skate (10) includes an upper shoe portion (12) secured to a frame (16) by a base (14). The frame (16) carries a plurality of wheels (18). The upper shoe portion includes an internal elastomeric support layer (50) that includes first and second recesses (54) which receive bladders (32) on either side of the ankle joint. Each bladder is constructed from a pliant envelope (62) that contains a reverse thermal gel (60). The support layer is backed by a rigid ankle cuff (28) also mounted internally within the upper shoe portion. The reverse thermal gel filled bladders (32) conform to closely fit the malleoli of the ankle joint when the foot is received within the upper shoe portion of the skate. The reverse thermal gel is initially a low viscosity liquid which readily conforms to the anatomic structure of the ankle joint. Upon warming from the body heat of the received foot, the reverse thermal gel thickens to a significantly higher viscosity to provide an increased degree of support and stability to the ankle joint. Multi-chambered bladders (70) which permit custom volumetric adjustment of the reverse thermal gel filled bladder are also disclosed.

28 Claims, 7 Drawing Sheets

IN-LINE SKATE WITH TEMPERATURE DEPENDENT SUPPORT

FIELD OF THE INVENTION

The present invention relates to the construction of sport shoes, and particularly to sport shoes which must firmly support the user's foot and ankle during usage, and more particularly to in-line skates.

BACKGROUND OF THE INVENTION

A variety of athletic endeavors require shoes which firmly support a user's foot and/or ankle. Flexion of the ankle joint may be required to be inhibited in certain directions while permitted in other directions, with the particular support requirements varying depending on the sport. For example, in in-line skating, it is desirable to permit the ankle to flex fore and aft during usage, while it is also desirable to inhibit lateral, or side to side, flexion so that the skate remains properly positioned relative to the user's leg and the ground during skating. In-line skates typically incorporate a shoe having an upper secured to a frame which carries a plurality of wheels along a common longitudinal axis. For maximum control and efficiency of force transfer, it is desirable to maintain the skate wheels and upper in a substantially vertical position, i.e., perpendicular to the plane of the ground. In-line roller skating is generally considered to require higher levels of skill, coordination and strength than conventional paired-wheel roller skating because of the narrow lateral support base associated with in-line roller skate wheels. While balancing in the forward and rearward direction is relatively easy, balancing in the sideward or lateral direction is difficult due to the narrow support base. Thus, proper ankle and foot support within the upper shoe portion of the skate is important. Support considerations for ice skates are similar to those for in-line skates.

Other athletic shoes have differing requirements. For example, a snowboard boot preferably supports the user's ankle so as to control and limit forward and aft flexion, for proper edge control of the snowboard. However, at least some lateral and medial, or side to side, flexion is desired.

Athletic shoes are thus designed and constructed to attempt to provide the type and degree of support required for a particular sport. This task is complicated, however, by the innate variance in anatomical structure from individual to individual. For example, the location of the malleoli, i.e., the laterally protruding ends of the tibia and fibia at the talocrural (ankle) joint, varies upwardly and downwardly from individual to individual. If an athletic shoe which must support the ankle is designed to closely conform to and support the malleoli of any given "nominal" individual, this same shoe may uncomfortably pressure ankles which are upperly or lowerly displaced from nominal for other individuals. To accommodate this variance, athletic shoes which support the ankle, such as in-line skate shoe uppers, typically provide an enlarged recess around the malleoli that will accommodate normal anatomical variance. However, this requirement necessarily induces a certain degree of undesirable loose fit, or "slop", around the ankle joint, which, while avoiding discomfort, also reduces the degree of support and control. Similar difficulties may arise in attempting to properly support variations in the conformation of individuals' heels, metatarsal head regions, arches, and insteps.

To some degree, adjustment for differing foot volumes and support requirements can be provided by adjustable shoe closures. For example, in-line skate boots typically have one of several different types of construction. The most commonly found construction entails a shoe upper constructed from a rigid plastic boot which is secured to or integrally molded with a frame on the underside. The frame receives the plurality of wheels. The interior of the rigid boot receives a removable foam liner. The rigid boot is secured and adjustably fitted around the liner by compression straps or lacings. The malleoli are accommodated within the ankle portion of the rigid boot by concave recesses formed in the interior of the boot on either side of the ankle. While the boot may be cinched down around the user's ankle and lower leg, the necessary slop built into the malleoli recesses and foam situated therein necessarily permits a certain amount of movement of the ankle joint in order to avoid extreme discomfort. Further, no provision is made for adjustment of the fit of the heel, which may shift laterally within the boot if the fit of the boot to that particular individual is not close. Likewise, no provision is made for adjustment of the fit and support around the metatarsal head region.

Another type of conventional in-line skate construction, disclosed in U.S. Pat. No. 5,437,466 to Meibock, the disclosure of which is hereby expressly incorporated by reference, utilizes a rigid base on the underside of which is secured a frame. The upper shoe portion of the skate is formed from a flexible, breathable material such as leather or fabric, which is internally cushioned with layers of foamed elastomer material. The upper shoe portion is secured to the upper surface of the base. A rigid support structure extends upwardly from the base on the outside of the flexible upper shoe portion. The support structure includes a heel cup and a pivoting ankle cuff. Malleoli recesses are provided within the cuff. The flexible upper shoe portion is closed by lacing and/or compression straps, which provides a better fit than that afforded by the rigid plastic boots of other skates. However, the degree of adjustment for fit and support is still limited to a certain degree.

Another type of in-line skate construction utilizes a flexible upper shoe portion that is again bonded to a rigid base to which a frame is secured for the mounting of wheels. The flexible upper shoe portion is reinforced internally by a heel cup secured to the base, and a pivoting ankle cuff, mounted internally within the exterior fabric of the upper shoe portion. The upper shoe portion is completed by layers of foam padding which are secured within the interior of the internal supporting structure. Such a construction is disclosed in pending U.S. patent application Ser. No. 08/668,278, filed Jun. 12, 1996, the disclosure of which is hereby expressly incorporated by reference. The innermost foam layer is contoured around the malleoli to create malleoli recesses, which are backed by corresponding recesses formed in the internal ankle cuff. This construction again provides considerable improvement over the comfort and fit of rigid-shelled in-line skates. However, a certain degree of looseness is necessarily required around the malleoli and other locations of the shoe.

Attempts have been made in sport shoe construction to incorporate plastic materials, such a putties or gels, into the interior of the shoe, in order to more closely conform to a particular user's anatomical structure and size. Conventional in-line skates have been constructed which contain a putty contained within a pouch on either side of the malleoli. The putty within the pouch is deformed by the malleoli when the upper of the skate is secured around the user's ankle, providing a fit which is customized to a certain extent. However, this construction suffers from the tendency of such putties or other conventional plastic materials to reduce in yield stress (i.e., to thin or become less viscous) when warmed. Thus, when the skate is initially fitted on the user and use begins, the putty is stiff and uncomfortable. The putty gradually warms due to heat transferred from the user's foot and ankle, becoming thinner, more malleable, and providing less support. As the putty is deformed, the skate may become more comfortable; however, the support provided by the warmed putty reduces the degree of support provided, exactly opposite the effect which would be optimum.

Further solutions to the fit problem have been presented by gels developed in recent years which are responsive to temperature. A first type of thermally response gel shrinks in volume by expressing a liquid solute when heated above a threshold temperature. Another type of thermally responsive gel is a reverse thermal gel. The term "reverse thermal gel" refers to a material which undergoes a dramatic increase in viscosity or yield stress as it is warmed from an initial temperature to an elevated temperature. Examples of thermally responsive gels and usages therefor are disclosed in International PCT Application Serial No. WO96/28057, published Sep. 19, 1996 and in International PCT Application Serial No. WO96/28056, published Sep. 19, 1996. These references disclose a variety of types of gels which go through a transition in response to an environmental trigger such as temperature. Conformable structures, including sporting equipment, which incorporate such gels within compliant plastic bladders are also disclosed.

In particular, the '056 PCT Application states that such bladders may be utilized in orthotics, socks, and joint and ankle supports. The bladder may include an internal foam layer, which further stiffens the contained reverse thermal gel after its transition due to the difficulty in flowing the thickened gel through the internal pores of the film. An alternate reverse thermal gel bladder construction including multiple chambers connected by passageways, which further stiffens the bladder because of the resistance to flow of the transitional gel through the narrow passageways, is also disclosed.

The '057 PCT Application further discloses the use of bladders containing reverse thermal gels or gels which express a liquid that are positioned in the heel, in the tongue, in the collar below the malleoli, in the foot bed, and in the metatarsal region of a shoe. Use of such temperature responsive gel filled bladders in a variety of athletic shoes, including skates and skis, and the use for ankle support, is stated generally but without any disclosure of critical features that would make it practicable and effective. The use of bladders including multiple chambers and narrow connecting passageways which contain and further stiffen reverse thermal gels is again suggested.

All of the applications of reverse thermal gel filled bladders disclosed in the two above-identified PCT Applications utilize the bladders to conform to anatomic structure of the user's foot and therefore more closely fit the foot. The reverse thermal gel is always contained within a single or multiple compartment fixed volume bladder. There is no mechanism disclosed for altering the volume of the reverse thermal gel which is incorporated into the bladder chamber or chambers that support the anatomic structure. The construction of a multiple compartment bladder having a first compartment which contains a gel that expresses a liquid into a separate compartment of the bladder upon temperature elevation is disclosed. However, such gels which express liquid upon heating dramatically shrink in volume when this transition occurs, and therefore provide significantly reduced support in the area where the gel is located after transition. Such volume transitioning gels are thus unsuitable in applications where it is desirable to provide an enhanced degree of support from the gel after transition. Further, there is no workable disclosure of how to incorporate any of the thermally responsive gels and bladders disclosed into an athletic shoe for the support of an ankle.

SUMMARY OF THE INVENTION

The present invention provides a sport shoe, such as an in-line skate shoe, for receiving and supporting a user's lower foot, and which may also receive and support the user's ankle. The sport shoe includes an upper adapted to receive the user's lower foot and/or ankle, the upper defining an interior and an underside. A base is secured to the underside of the upper. A bladder is mounted within the interior of the upper. The bladder defines a support chamber, a reservoir chamber, and a passageway which serves as a valve placing the support chamber in fluid communication with the reservoir chamber. The bladder includes a pliant wall forming at least a portion of the support chamber. The support chamber is disposed adjacent an anatomical feature of the received foot that is to be supported. A deformable plastic material, such as a reverse thermal gel, is received within at least the support chamber of the bladder. The plastic material is deformable via the pliant wall to conform to the received anatomical feature. The plastic material has a viscosity that increases in response to warming of the plastic material from an ambient temperature to an elevated temperature upon heat transfer from the received foot. The plastic material and the passageway are configured so that the plastic material flows through the passageway into the reservoir chamber at the ambient temperature, but is substantially inhibited from flowing through the valve at the elevated temperature. The sport shoe further includes a reverse flow mechanism acting on the bladder for urging the plastic material to return from the reservoir chamber to the support chamber when the plastic material cools to the ambient temperature after use.

In a further aspect of the present invention, the sport shoe is configured as a roller skate including an upper shoe portion that receives and supports the user's foot and ankle, and a plurality of wheels. The roller skate includes a frame for rotatably mounting the plurality of wheels. The frame defines an upper side. An upper is secured to the upper side of the frame, and is adapted to receive a user's foot and ankle. A rigid support is connected to the frame and extends outwardly and upwardly therefrom to at least partially surround the received ankle. The rigid support defines an interior. A bladder mounted within the interior of the rigid support includes a pliant wall disposed adjacent the received ankle. The plastic material received within the bladder substantially conform to the ankle joint. The plastic material has a viscosity that increases in response to warming of the plastic material from an ambient temperature, due to heat transferred from the received foot and ankle, for increased support of the ankle, to control lateral movement.

In a still further aspect of the invention, a method is disclosed for producing a sport shoe including a molded elastomeric support layer received within the interior of an upper and configured to surround an anatomical feature of the received foot. The bladder, including a plastic material such as that described above, is at least partially internally molded within the elastomeric or foamed elastomeric support layer.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
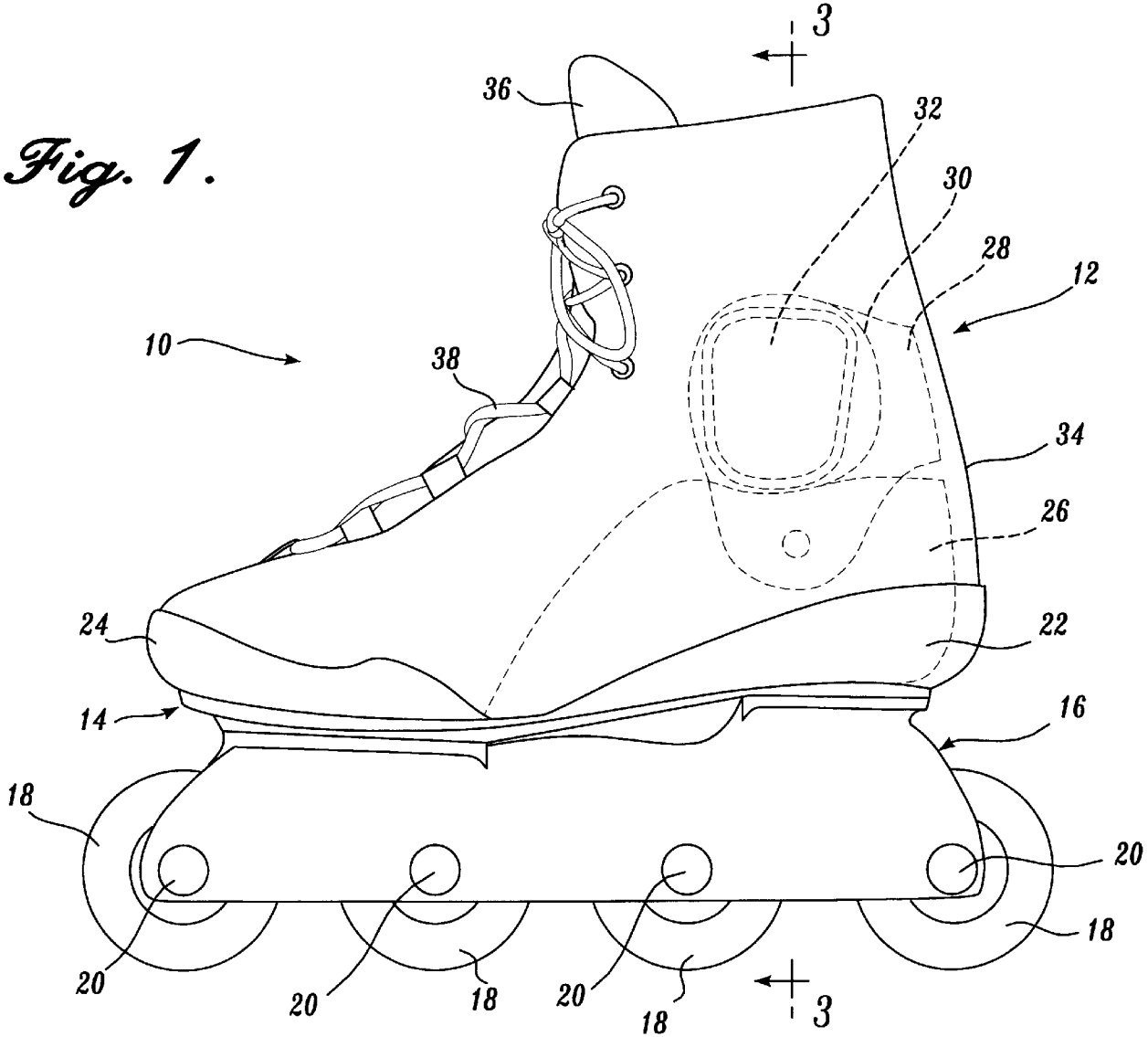
FIG. 1 provides a side view of an in-line skate constructed in accordance with the present invention.

The present invention provides an athletic shoe, which in a preferred embodiment is configured as an in-line skate 10 such as that illustrated in FIG. 1. The skate 10 includes an upper shoe portion 12 which receives the user's foot and ankle. The upper shoe portion 12 is secured to a rigid base 14. A frame 16 is secured to the underside of the rigid base, and carries a plurality of wheels 18 journaled on axles 20 within the frame 16. The upper shoe portion 12 is reinforced by a heel rim 22 that projects outwardly from the base 14, surrounding the lower portion of the exterior heel area of the upper shoe portion 12, and a toe rim 24, which surrounds and is secured to the lower portions of the exterior toe region of the upper shoe portion 12. The upper shoe portion 12 is further internally reinforced by a heel cup 26, which is secured to the base 14 and extends upwardly therefrom, terminating just below the ankle joint of the user. An internal pivoting ankle cuff 28 is pivotably secured to the upper extremities of the heel cup 26. The pivoting ankle cuff 28 includes first and second malleoli recesses 30 (only one of which is shown in FIG. 1). First and second bladders 32 filled with a temperature responsive plastic material are mounted within the interior of the upper shoe portion 12 adjacent the malleoli recesses 30, as shall be described subsequently. Alternately, the recesses 30 may be more shallow than illustrated, or nonexistent.

While the preferred embodiment of the athletic shoe illustrated in FIG. 1 is an in-line skate shoe, it is to be understood that the present invention is well suited for the construction of other athletic shoes, such as snowboard boots, cross-country or downhill ski boots, and ice skate boots. Reference is made herein to a shoe which is adapted to receive a person's "foot", and this term is intended to encompass a shoe which at least partially surrounds the lower foot and which may also extend upwardly sufficiently far to partially or completely surround the ankle joint of the user. The term "ankle joint" is intended to refer to the talocrural joint, inclusive of the talus (e.g., ankle bone) and the malleoli of the tibia and fibula. The present invention is especially well adapted for use in athletic shoes which extend to support the ankle joint, and in which a high degree of fit, support and stability of the ankle joint is desired. In-line skate shoes are exemplary of such construction in accordance with the present invention.

Figure 2:
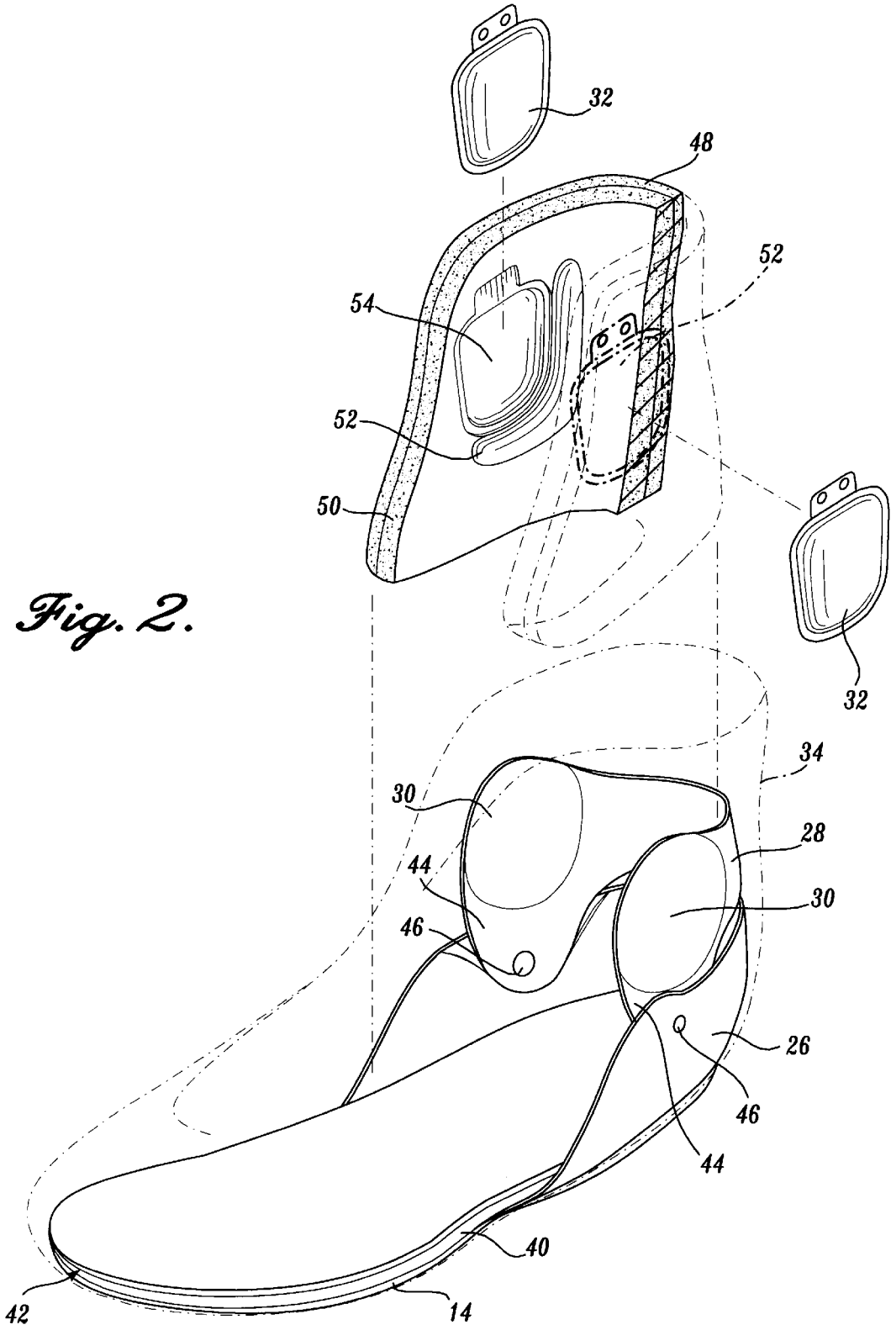
FIG. 2 provides an exploded view of the internal components of the upper shoe portion of the in-line skate of FIG. 1, with a portion of the internal foam padding around the ankle being cut away, the cutaway portion and the exterior of the upper shoe portion being shown in phantom.

The in-line skate 10 of FIG. 1 includes a flexible upper shoe portion 12. Referring to FIGS. 1 and 2, the upper shoe portion 12 includes an exterior fabric upper 34, which may be constructed from leather, woven nylon, flexible plastic sheet or combinations thereof. Preferably, the fabric upper34 is constructed from a breathable material. The upper shoe portion 12 also includes a vamp portion which includes a tongue 36 that passes over the instep and front side of the ankle. The vamp portion of the fabric upper 34 is closed over the tongue 36 by a lace 38. Other conventional closures, such as compression straps, may also be employed.

Attention is now directed to FIG. 2 to better understand the internal construction of the upper shoe portion 12. The base 14 has an upper surface which receives the user's foot. The lower edge of the internal heel cup 26 is adhered or otherwise secured to the upper surface of the base 14. A last board 40, positioned over the upper surface of the base 14, aids in securing the lower extremities of the outer fabric 34 and the heel cup 26 to the base 14. The last board may be secured by a combination of rivets (not shown) and adhesive. An insole 42 overlays the last board.

The upper edge of the heel cup 26 is preferably recessed on either side to permit mounting of the pivoting ankle cuff 28. The ankle cuff 28 has a generally U-shaped configuration. Each end of the "U" includes a circular, outwardly extending malleoli recess 30, which is concave when viewed from the interior. Below each of the malleoli recesses30, the ankle cuff 28 forms a downwardly extending pivot portion 44. The pivot portions 44 are pivotally secured by rivets 46 to either side of the heel cup 26. The pivoting ankle cuff 28 is arranged and mounted such that the malleoli recesses 30 are nominally disposed over the malleoli of the ankle joint, as determined by the average physique of an individual. The malleoli recesses 30 are oversized so as to accommodate upward or downward variation of the ankle joints, or fore and aft variation, from individual to individual.

The interior of the ankle region of the upper shoe portion 12 is padded with multiple layers of an elastomeric material, such as an elastomeric neoprene rubber or polyurethane foam. A backing layer 48 of foam is received immediately within the interior of the ankle cuff 28 and heel cup 26. A contoured support layer 50 of elastomeric foam is adhered to the interior of the backing layer48. The interior surface of the support layer 50 is contoured to provide support and comfort to the malleoli. Specifically, on each side of the interior, the support layer 50 includes a molded ridge 52. The molded ridge 52 has a general "L" shape, with a first leg extending below and a second leg extending upwardly behind the corresponding malleoli location of the user's foot. A bladder recess 54 is molded into the interior surface of each side of the support layer 50, immediately above the lower leg of the ridge 52. The cushioned ridge 52 thus surrounds the lower and rearward sides of each recess 54. Each recess 54 is dimensioned and configured to correspond to and receive an outer side of the corresponding thermally responsive plastic filled bladder 32. In the preferred embodiment illustrated in FIG. 2, each bladder 32 is secured within the bladder recess 54 with an adhesive. Each bladder 32 has a size generally corresponding to the malleoli recess 30 of the ankle cuff 28, as can also be seen in FIG. 1. Each bladder 32 is dimensioned such that it extends both taller and wider than the malleoli of any given individual, thus accommodating lateral and fore and aft variations in malleoli location.

Figure 3:
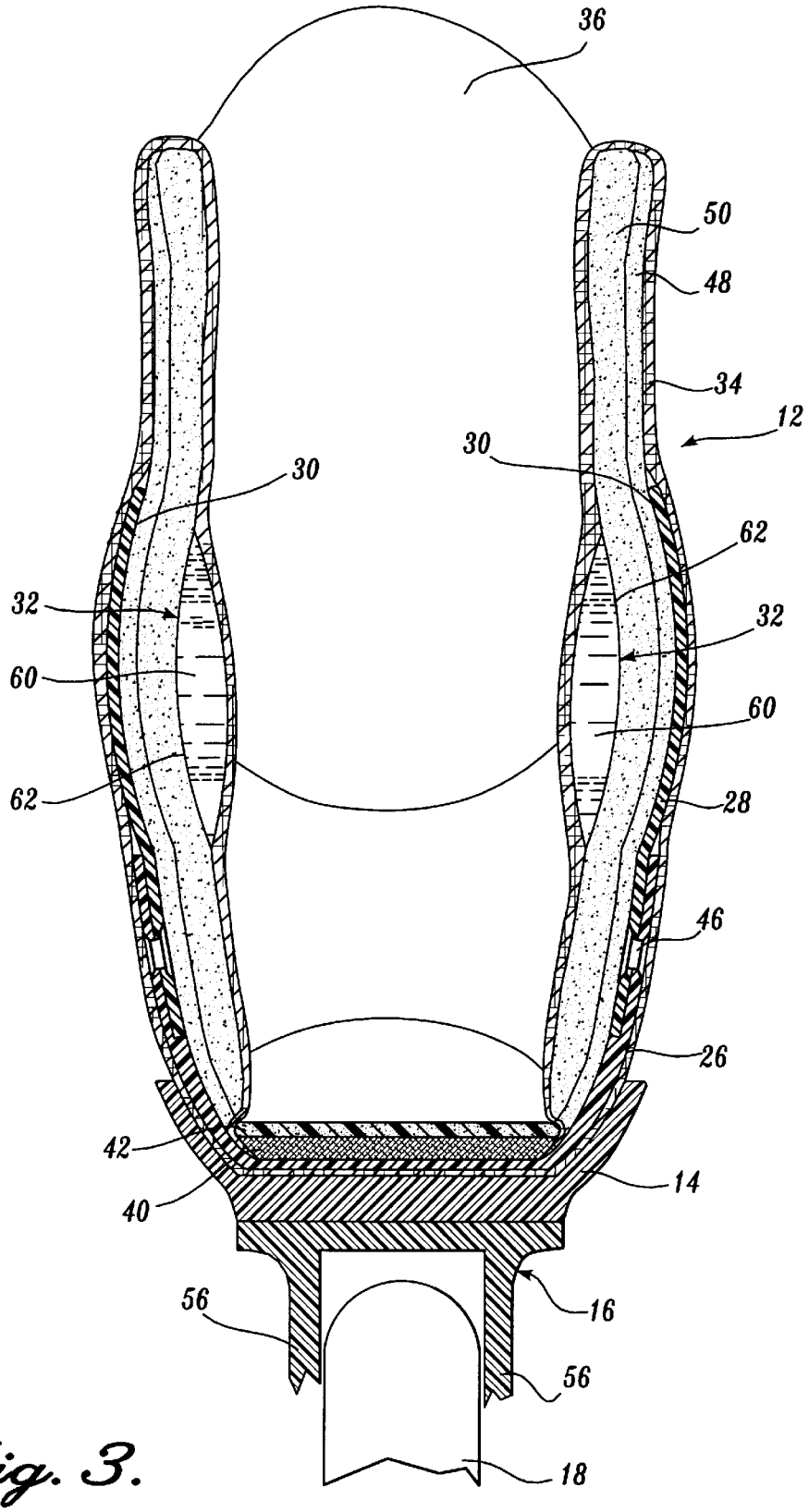
FIG. 3 provides a cross-sectional view of the in-line skate of FIG. 1 taken substantially along a medial plane passing through the ankle region of the shoe and looking forward therefrom.

Construction of the upper portion 12 of the in-line skate 10 may be further understood with reference to the cross section of FIG. 3. It can be seen that the frame 16 includes first and second downwardly projecting flanges 56. The flanges 56 are spaced apart, and receive the wheels 18 therebetween on bearings. The frame 16 is bolted, riveted, or integrally formed on the lower side of the base 14. The base 14 is lasted to the upper shoe portion, as previously noted.

The upper shoe portion 12, previously discussed with reference to FIG. 2, is further illustrated in FIG. 3. The upper shoe portion 12 is completed by an interior liner, typically a breathable fabric material, which covers the inside of the support layer 50 and an inner side of the bladders 32 received thereon. The bladders 32 are thus mounted on the interior of the elastomeric support layer 50, and are separated from the user's ankle joint only by the fabric liner, for optimum heat transfer. Additional thin layers of elastomeric foam padding may alternately cover the inner surface of the bladders 32. Each bladder 32 is identical, with one bladder being provided on the left side and a second bladder being provided on the right side of the ankle joint. Each bladder 32 includes a thermally responsive plastic material, preferably a reverse thermal gel 60, contained within a compliant barrier envelope 62.

The term "reverse thermal gel," as utilized herein, refers to a material which undergoes a dramatic increase in viscosity or yield stress as it is warmed from an initial temperature to an elevated temperature, or as it is elevated from a temperature below a transition temperature to a temperature above the transition temperature. Suitable reverse thermal gels 60 are available commercially from Gel Sciences, Inc., of Waltham, Mass.

Examples of suitable reverse thermal gels for use in the present invention are also disclosed in International PCT Application Serial Nos. WO96/28057 and WO96/28056, each published Sep. 19, 1996 and designating the United States, the disclosures of which are hereby expressly incorporated by reference. A first type of reverse thermal gels disclosed therein, which are suitable for use in the present invention, consist of reversibly gelling polymer networks which contain a responsive component capable of aggregation in response to a change in environmental stimulus, such as temperature, and a structural component which supports and interacts with the responsive component in an aqueous-based solvent. The reversibly gelling polymer may be a tri-block polyol with a general formula (EO)(PO)(EO), alone or in the presence of other gel polymers. The responsive component responds to a stimulus, such as a temperature stimulus, to change its degree of association and/or agglomeration. The structural component supports and interacts with the responsive component so that a multi-material responsive polymer network is formed. An exemplary structural component is sodium acrylate. The responsive and structural components are dissolved, typically at a level of 2 to 4% by weight, in an aqueous-based solvent. In this type of thermally responsive gels, the viscosity of the gel increases at least ten fold with an increase of about 5° C.

A second type of reverse thermal gels disclosed in the above mentioned PCT Applications, also suitable for use in the present invention, are tri-block co-polymers of poly (ethylene oxide)-poly(propylene oxide)-poly(ethylene oxide) in an aqueous solution, available under the tradenames Pluronics or Poloxomers. This type of thermally responsive gel exhibits a dramatic increase in viscosity as the liquid solution or dispersion is heated past a predetermined transition temperature, forming a gel. The initial viscosity of the solution increases upon gelling, as the solution is heated past a gel transition temperature, in the range of 5 to 100-times, and typically 10 to 50-times, the original viscosity. Such solutions may include polymer at concentration levels of 16% by weight or higher. Transition temperatures of approximately 30° C. to 34° C. can be obtained by adjusting the concentration of the polymers and the pH of the gels. The gelled state has sufficient mechanical strength to conform and provide support to a foot.

The envelope 62 of the bladder 32 is preferably made from a resilient, pliant, film of water-impervious material, such as a hydrocarbon-based film, e.g., polyethylene or polypropylene, or more preferably a polyurethane/polyvinylidine chloride/polyurethane laminate, or potentially a multi-layered composite film reinforced with metallic laminates. The envelope 62 includes first and second sides which are bonded together, such as by heat sealing, i.e., thermal welding, or radio frequency welding. Each side of the envelope 62 is flexible and compliant. The first side of each envelope 62 is adhered to the corresponding recess 54 in the support layer 50, as shown in FIG. 3, while the opposing side of the envelope 62 faces inwardly towards the ankle joint. It should be apparent that an alternate mounting method could be utilized. For instance, the recess 54 in the support layer 50 could form one side of the envelope 62, so long as the support layer 50 includes an outer skin which is water impervious. In this alternate construction (not shown), a single layer of film would be adhered around its edges to the edges of the recess 54, with the reverse thermal gel 60 captured therebetween, to complete the bladder 32.

At typical ambient temperatures in which in-line skates are utilized, i.e., approximately 32° F. to 80° F. (0° C. to 27° C.), the reverse thermal gel 60 has the consistency of a thin, easily deformed liquid. When the skate 10 is placed on the user's foot and the vamp is closed by tightening the lace 38, the malleoli of the user's ankle protrude into the bladders 32, deforming the inner facing wall of the envelope 62 and the reverse thermal gel 60 contained therein. The inner wall of the bladder 32 and the reverse thermal gel 60 thus closely conform to the anatomic structure of the user's ankle. As the skate continues to be worn, heat conducted from the user's foot and ankle begins to warm the reverse thermal gel 60. In particular, the reverse thermal gel 60 is gradually warmed to a temperature approaching human body temperature, i.e., approximately 90° F. to 98.6° F. (32° C. to 37° C.). Depending on the exact composition of the reverse thermal gel 60 utilized, the reverse thermal gel 60 then either begins to gradually thicken as it is warmed, or thickens rapidly as it is warmed past a predetermined threshold temperature. The predetermined upper end of the temperature range over which the first type of gel thickens, and the predetermined threshold temperature at which the second type of reverse thermal gel 60 thickens, is selected based on expected temperatures adjacent the specific anatomic feature of the user's foot to be supported. If the bladder 32 is positioned at a location of the skate 10 which is well ventilated, the reverse thermal gel 60 will be formulated by adjusting polymer constituent makeup, concentration or pH, to thicken at a lower predetermined temperature than for a location of the skate 10 which is not well ventilated. For example, the reverse thermal gel 60 may suitably be formulated such that it thickens as it is warmed from an ambient temperature to an elevated temperature which may be approximately above 80° F. (27° C.), and preferably from 90° F. to 98.6° F. (32° C. to 37° C.). This predetermined temperature may vary depending on whether the sport shoe is intended for use in a summer or winter sport. Winter sport shoes may require lower transition temperatures. Once the reverse thermal gel 60 has sufficiently warmed to undergo its transition, the gel increases substantially, and preferably at least five times, in yield strength and viscosity. The reverse thermal gel 60 in this state is much firmer and resistant to flow, and is maintained in this state in the custom fitted confirmation around the user's ankle.

This custom fit provided by the transitioned reverse thermal gel 60 within the bladders 32 is both highly comfortable and provides a high degree of support and stability to the ankle joint. In the preferred embodiment illustrated in FIGS. 1–3 of an in-line skate, the support is provided on either side of the ankle joint, thereby significantly preventing undesirable lateral flexion. At the same time, forward and aft flexion of the ankle joint within the upper shoe portion 12 is permitted. It should be readily apparent to those of ordinary skill in the art that by placing the bladders 32 at differing locations in upper shoe portion 12 of a sport shoe, that differing support effects can be obtained. Thus, in a snowboard boot (not shown), the bladders 32 could be mounted in a similar fashion as that shown for in-line skate 10, but on the forward and rear sides of the ankle joint (at the transition of the shin to the upper foot and in the Achilles area), to support and minimize forward and aft flexion, while permitting lateral flexion.

Figure 4:
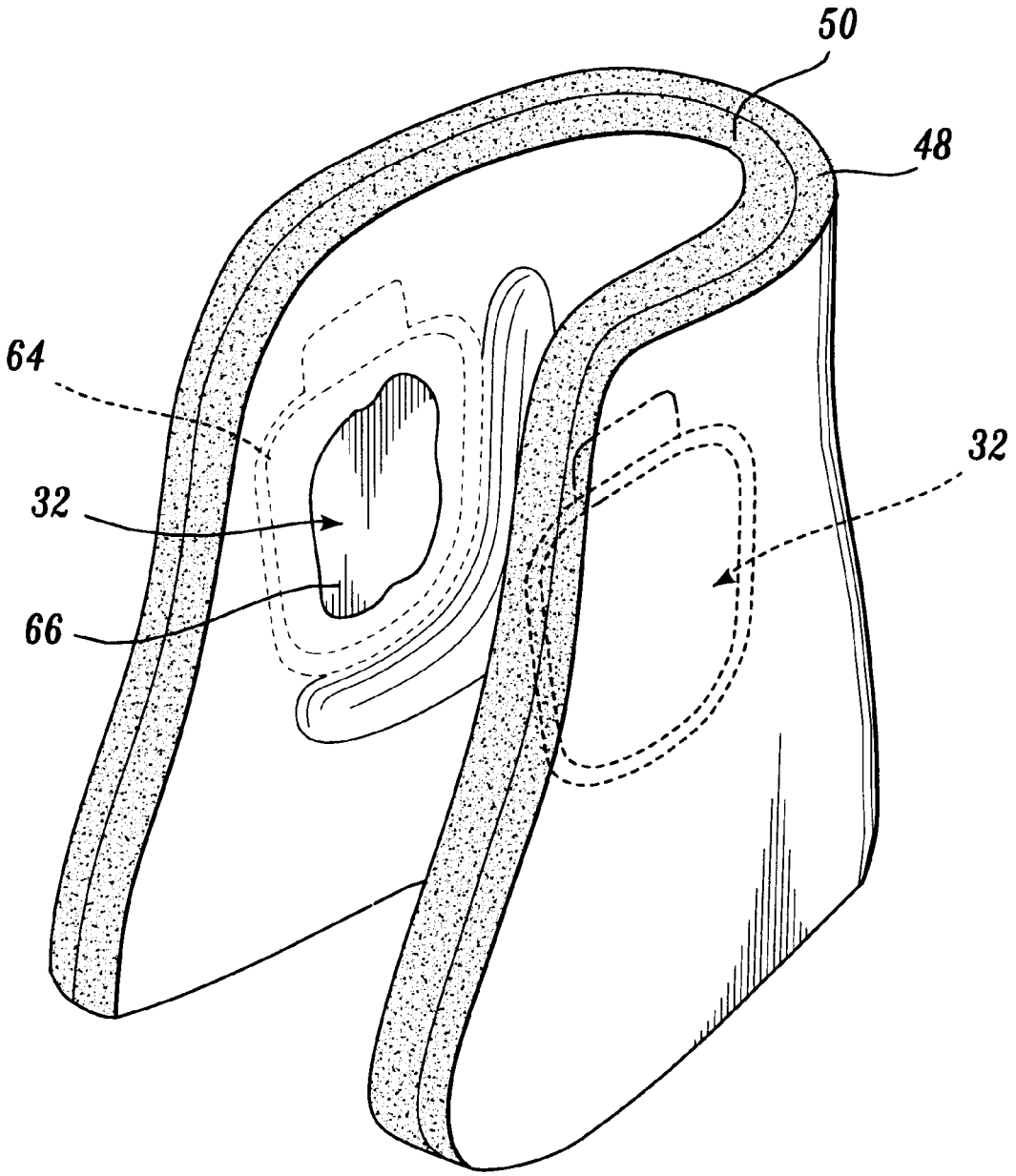
FIG. 4 illustrates an alternate mounting of the gel filled bladder internally molded within the elastomeric support layer of the ankle region for the in-line skate of FIG. 1.

While the preferred embodiment of FIGS. 1–3 has been described as having the bladders 32 adhered within preformed recesses 54 molded within an elastomeric support layer 50, alternate methods of mounting the bladders may be utilized. One such method is illustrated in FIG. 4. In this illustrated embodiment, the bladders 32 are internally and integrally molded within the support layer 50. The material from which the support layer 50 if formed thus surrounds the outer side and the edges of each bladder 32. The material of the support layer 50 further surrounds at least a perimeter edge portion 64 of the innerfacing side of the envelope 62 of the bladder 32. A central portion 66 of the bladder 32 is preferably only covered by a thin film of the elastomeric material from which the support layer 50 is formed, or still more preferably is exposed through the support layer 50 material, and then covered by the fabric liner 58, as shown in FIG. 4, for maximum heat transfer.

The support layer 50 with internally embedded bladders 32 can be manufactured by at least two methods. A first method entails positioning bladders 32 within one half of a mold cavity by aligning apertures formed in an edge portion of the envelope 62 with mold pins. The other half of the mold cavity is then mated with the first half to close the mold, and an uncured elastomeric foam resin mixture is injected into the mold, whereupon it cures to form the desired contours of the support layer 50. This process results in the prepositioned bladders 32 being integrally molded within the support layer 50. This method is highly efficient and provides reproducible and accurate placement, and thus is preferred over the previously described method of adhering the bladders in place. A second method involves pouring the uncured foam into an open topped mold cavity, and then placing the bladders 32 onto the top of the liquid, uncured material. The bladders 32 settle slightly into the material, which then cures to complete the support layer 50.

The bladders 32 described above in relation to FIGS. 1–4 are each fixed volume bladders. Thus a fixed, predetermined volume of reverse thermal gel 60 is presented adjacent the ankle or other anatomic structure to be supported. The confirmation of the reverse thermal gel 60 within the bladder changes when the bladder conforms to the anatomic structure. However, the volume of reverse thermal gel 60 in the bladder does not change. Another alternate embodiment of the present invention is directed to a reverse thermal gel contained within a bladder including multiple chambers, such that the volume of the reverse thermal gel available adjacent an anatomic structure is adjusted in response to the size and contours of the anatomic structure. One such embodiment of the present invention is illustrated in FIG. 5.

Figure 5:
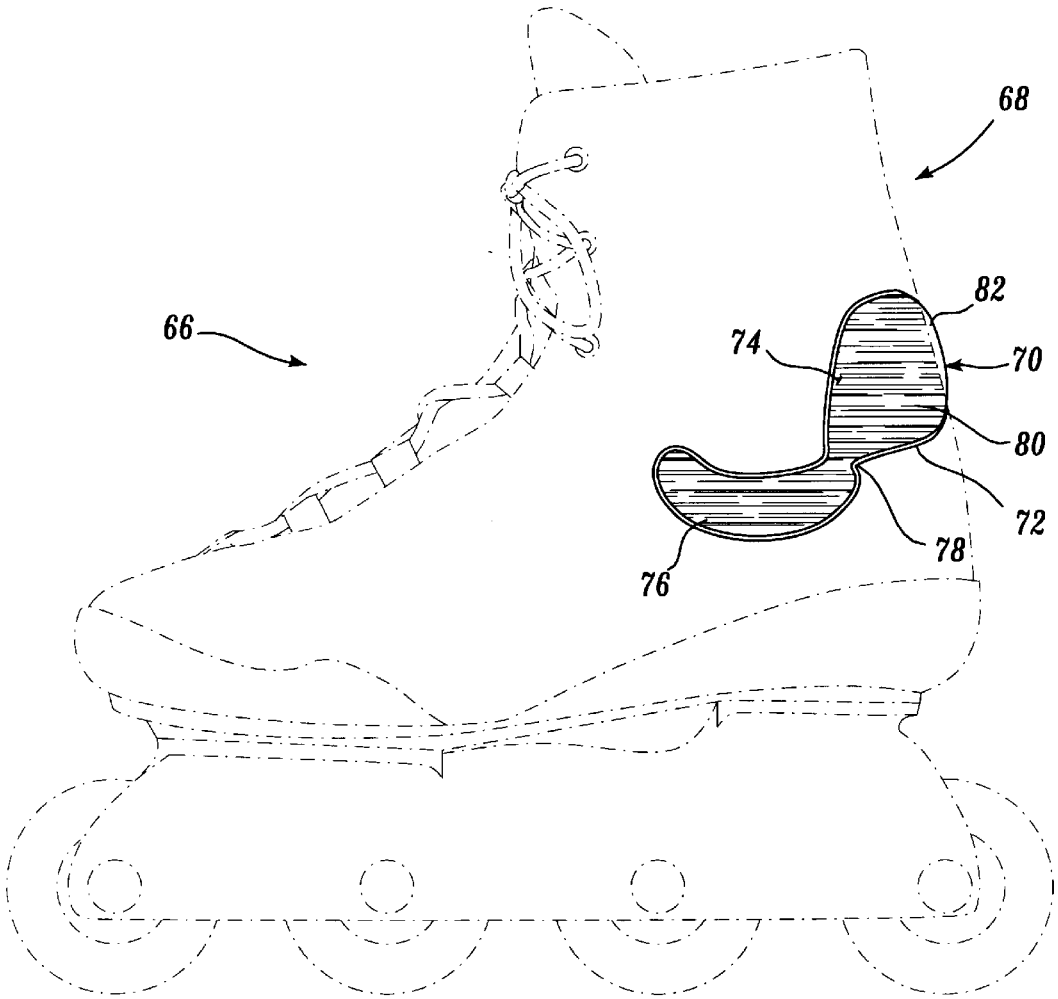
FIG. 5 provides a side elevation view of an alternate embodiment of an in-line skate constructed in accordance with the present invention, wherein the skate (shown in phantom) includes a gel filled bladder having support chambers which support the ankle and a reservoir chamber.

The in-line skate 66 illustrated in FIG. 5 includes an upper shoe portion 68 that is constructed identically to that previously described with relation to the in-line skate 10, except for the formation and mounting of a multi-chambered bladder 70. The multi-chambered bladder 70 is similar in some respects to the previously described single chambered bladder 32. Thus the multi-chambered bladder 70 includes an envelope 72 which contains reverse thermal gel 74. The multi-chambered 70 differs from the previously described single chambered bladder 32 only in the shape and positioning of the envelope 72. Specifically, the envelope 72 is partitioned into three chambers which are connected by narrow passages. The envelope 72 includes a first support chamber 76 which is connected by a first orifice valve passage 78 to a reservoir chamber 80. The envelope 72 further includes a second orifice valve passage (not shown) connecting the reservoir chamber 80 in fluid flow communication with a second support chamber (not shown). The first and second support chambers are disposed on either side of the upper shoe portion 68 to support opposing malleoli of a received ankle joint. The first and second support chambers are in fluid communication with the reservoir chamber 80, which reversibly expands to receive excess reverse thermal gel 74 from the support chambers when the skate is initially placed on a foot, thereafter statically maintaining relative gel volumes during usage. After usage, when the gel cools, the reservoir chamber 80 contracts to its original volume.

The bladder 70 is positioned to wrap around the back and sides of the ankle joint. The reservoir chamber 80 is centrally disposed between the first and second support chambers, immediately behind the Achilles tendon area of the foot. The reservoir chamber 80 is elevated relative to the first and second support chambers, which extend downwardly and forwardly on either side of the reservoir chamber 80, below opposing malleoli of the ankle joint.

The first and second support chambers are preferably identically constructed and mounted within the upper shoe portion 68, and are each connected in fluid flow communication with the reservoir chamber 80. Thus only the first support chamber 76 is illustrated in FIG. 5 and described to avoid redundancy. The first support chamber 76 is generally elongate and arcuate, curving upwardly around the underside of the corresponding malleoli of an ankle joint. The first support chamber 76 thus extends generally horizontally and longitudinally along one side of the upper shoe portion 68, immediately below the malleoli. The first support chamber 76 is mounted internally within the elastomeric support layer 50 (not shown in FIG. 5), and is covered only by the internal fabric liner 58 (not shown in FIG. 5), so that it is immediately adjacent the ankle joint.

The first orifice valve passage 78 is formed by a narrowing in the width of the envelope 72, such that only a narrow passage is permitted between the first support chamber 76 and reservoir chamber 80, defined on opposite sides of the first orifice valve passage 78. The dimensions of the envelope 72 then expand to form the enlarged reservoir chamber 80 disposed behind the ankle joint. However, rather than being sandwiched between the support layer 50 and the received foot, the reservoir chamber 80 protrudes outwardly through a recess formed in the support layer 50. In the preferred embodiment illustrated, a rearward portion 82 of the reservoir chamber 80 is externally exposed through an aperture formed in the outer fabric upper 34 of the upper shoe portion 68. The reservoir chamber 80 is thus not compressed between the support layer 50 and foot, as is the first support chamber 76. As such, the reservoir chamber 80 is located at a low pressure area of the foot. Alternately, the reservoir chamber 80 may be positioned at any other low pressure location within or externally of the upper shoe portion 16.

When the user first inserts his or her foot into the in-line skate 66, the reverse thermal gel 74 is contained within the first support chamber 76 and second support chamber. When the upper shoe portion 68 is closed around the ankle, the reverse thermal gel 74 and envelope 72 of the support chambers of the multi-chambered bladder 70 are compressed and conformed to the ankle joint. As these support chambers are compressed, excess reverse thermal gel 74 flows upwardly through the first orifice valve passage 78 and second orifice valve passage to the reservoir chamber 80. The volume of reverse thermal gel 74 contained within the first and second support chambers is thus adjusted on a customized basis corresponding to the volume of the user's ankle. Because the reservoir chamber 80 is not compressed by the user's foot, the reverse thermal gel 74 freely flows into the reservoir chamber 80.

The diameter and length of the first orifice valve passage 78 and second orifice valve passage are predetermined such that reverse thermal gel 74, in its non-viscous state at ambient temperature, flows freely through the valve passages to the reservoir chamber 80. However, when the reverse thermal gel transitions to its thickened, more viscous state, flow through the narrow orifice valve passages 78 is substantially inhibited. In particular, the transition to the thickened skate due to warming takes place within approximately five minutes of initially inserting the foot into the skate 66. Thereafter, once the reverse thermal gel 74 is thickened, the first orifice valve passage 78 and second orifice valve passage are dimensioned such that no appreciable volumes of reverse thermal gel 74 flow through the orifice valve passages into the reservoir chamber 80 during a predetermined usage period, which typically will be a period of from 30 minutes to 8 hours.

After the in-line skate 66 is removed from the user's foot, the reverse thermal gel 74 flows back downwardly from the reservoir chamber 80 into the first support chamber 76 and second support chamber. This flow is possible once the reverse thermal gel 74 cools back down to ambient temperatures and transitions to its non-viscous state. The return flow is urged by one or more mechanisms. In the embodiment illustrated in FIG. 5, the flow from the reservoir chamber to the support chambers is urged by gravity, due to the elevation of the reservoir chamber 80 above the first support chamber 76 and second support chamber. Preferably, this flow is also urged by a biasing force exhibited by material used to construct or mount the reservoir chamber portion 80 of the envelope 72 within the upper shoe portion. In the preferred embodiment, at least the rearward portion 82 of the reservoir chamber portion 80 is formed from a material having elastic properties which urge the reservoir chamber 80 to collapse. Alternately, an elastic membrane (not shown) may be secured within the upper shoe portion 68 on one or both sides of the reservoir chamber 80 to collapse the reservoir chamber 80 and to urge return of the reverse thermal gel 74 to the support chambers. A still alternate method of urging the reverse thermal gel 74 to return to the support chambers may be provided by manually depressing the rearward portion 82 of the reservoir chamber 80. One or a combination of these reverse flow mechanisms may be employed, i.e., gravity, biasing films or membranes, or manual activation.

Figure 6:
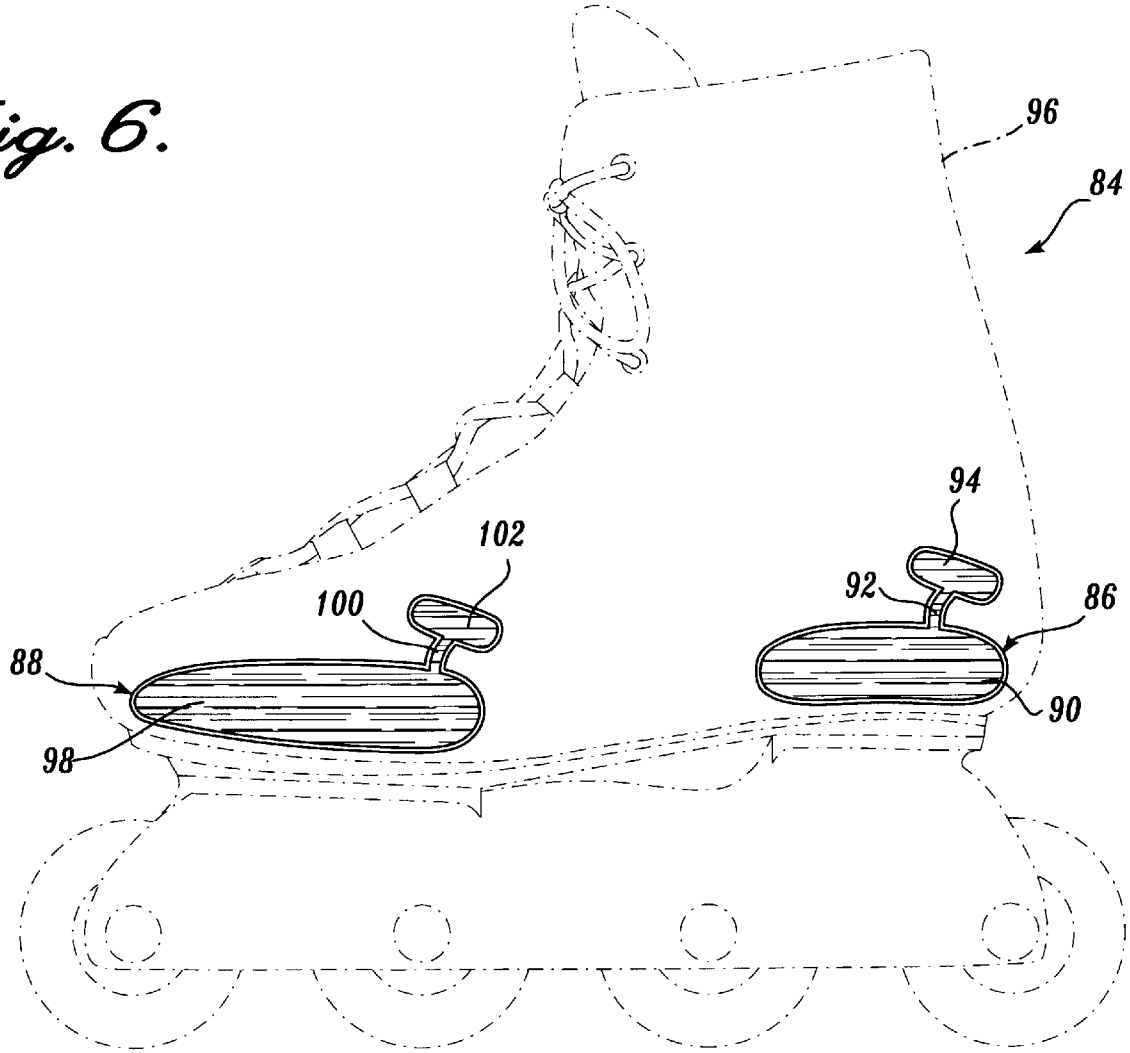
FIG. 6 provides a side elevation view of a further alternate embodiment of the present invention, including gel filled bladders having support chambers and reservoir chambers positioned in the metatarsal head region and heel region of the upper shoe portion of an in-line skate (shown in phantom)

Multi-chambered bladders containing reverse thermal gel 74 may also be utilized in other areas of a sport shoe to provide volumetric-adjustable, temperature dependent support to anatomic structure. Further examples of such usages are shown in FIG. 6, which illustrates an in-line skate 84 including left and right heel bladders 86 and left and right metatarsal bladders 88. The left and right heel bladders 86 each include a large support chamber 90 connected by a narrow valve passage 92 to a reservoir chamber 94. One heel bladder 86 is positioned on either side of the heel within the upper shoe portion 96 of the skate 84. The support chamber 90 of each heel bladder 86 is positioned within the interior of the elastomeric support layer (not shown), where it contacts and conforms to the heel of a user to support and prevent undesirable lateral movement of the heel within the upper shoe portion 96 of the skate 84. The reservoir chamber 94 is positioned in a low pressure area of the foot, such as in a recess defined in the support layer 50 of the upper shoe portion 96 adjacent the hollow typically present in a person's foot between the heel and ankle joint. The reservoir chamber 94 is again positioned above the support chamber 90, and connected thereto by a valve passage 92. At ambient temperatures, upon initial placement of the foot into the upper shoe portion 96, reverse thermal gel flows upwardly from the support chamber 90 through the valve passage 92 to the reservoir chamber 94. After becoming more viscous, further flow in either direction is prevented during usage at the elevated temperature. After the foot is removed from the shoe, the reverse thermal gel is free to flow downwardly under the effect of gravity and/or biasing pressures to return to the support chamber 90.

The metatarsal bladders 88 are similarly constructed, including a lower support chamber 98 connected by a valve passage 100 to an upper reservoir chamber 102. The support chambers 98 are positioned on either side of the metatarsal head region of the forefoot of the user. The reservoir chambers 102 are positioned in upper regions of the forefoot of the user which are not unduly pressured by the foot during usage.

Figure 7:
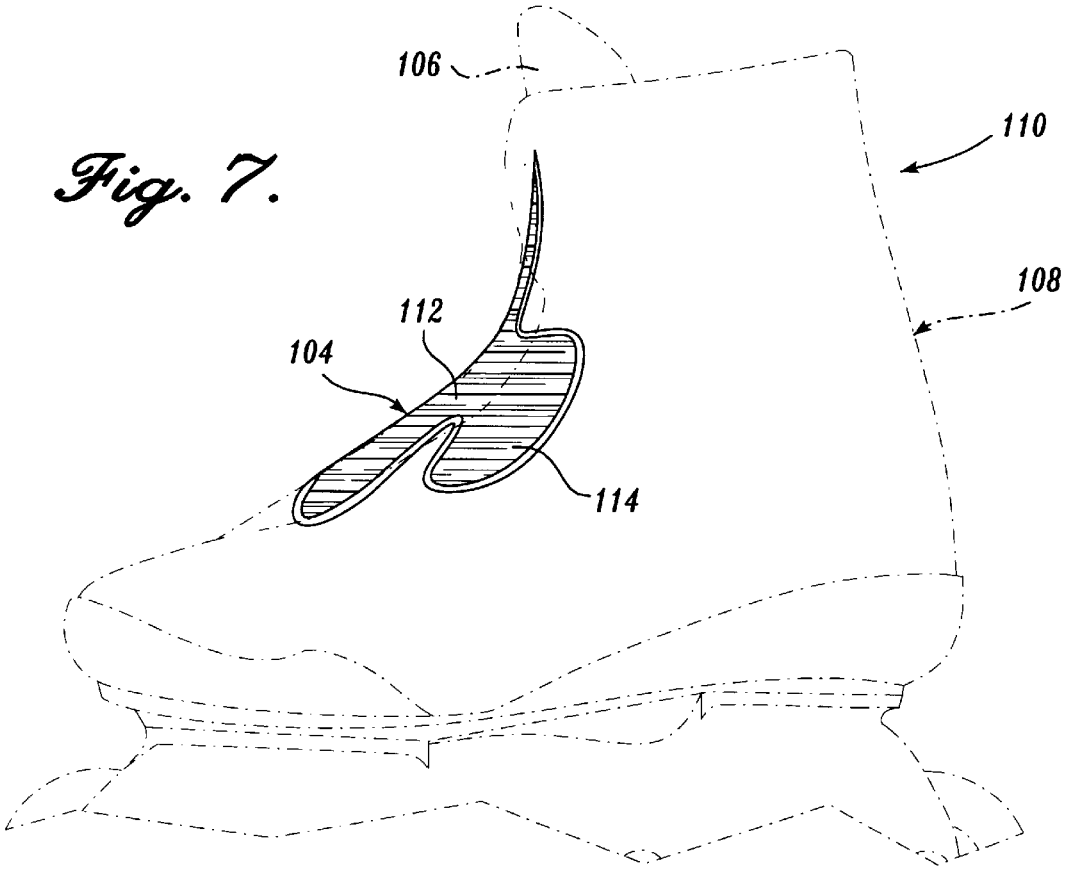
FIG. 7 provides a side elevation view of an alternate embodiment of an in-line skate constructed in accordance with the present invention, including a gel filled bladder having a support chamber and a reservoir chamber mounted within the tongue of the skate (shown in phantom)
Figure 8:
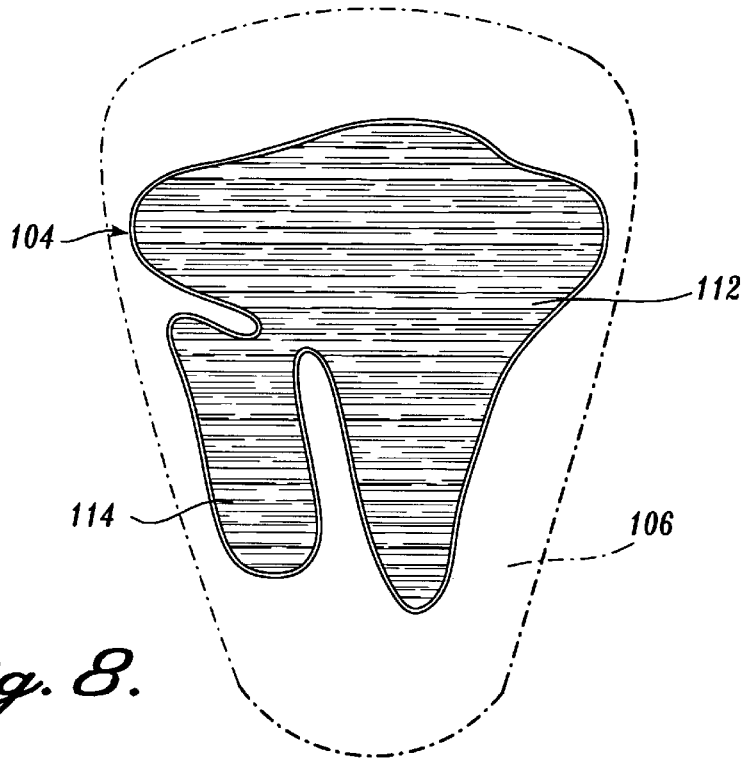
FIG. 8 provides a top plan view of the tongue (shown in phantom) of the skate of FIG. 7.

A still further example of the usage of a multi-chambered bladder 104 mounted within the tongue 106 of the upper shoe portion 108 of an in-line skate 10 is shown in FIGS. 7 and 8. The multi-chambered bladder 104 serves the purpose of adjusting the internal volume of the upper shoe portion 108 around the instep of a user's foot, in conjunction with the vamp closure, and for distribution of pressure along the instep of the person's foot. The bladder 104 stabilizes the talocalcaneal axis while protecting the extensor hallucis longus and surrounding structures. The multi-chambered bladder 104 includes a support chamber 112 which is compressed by the vamp closure over the instep, and a reservoir chamber 114 positioned off to one side of the support chamber 112 so that it will lie against a naturally occurring, low pressure hollow in the upper portion of a user's foot.

While the aforementioned embodiments of the present invention have been illustrated and described as used in an in-line skate constructed from a flexible upper with an internal rigidizing support, the present invention is also well suited for use in alternately constructed sport shoes. Thus, for example, the present invention may be adapted for use within an in-line skate constructed from a flexible upper that is supported by an external rigid support, such as that disclosed in U.S. Pat. No. 5,437,466 to Meibock, or in in-line skates constructed from a rigid plastic outer shell that receives a removable elastomeric foamed liner. As noted previously, the present invention may also be adapted for use in differing types of sport shoes, including snowboard shoes.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A sport shoe for receiving and supporting a user's foot, comprising:

an upper adapted to receive a user's foot, the upper defining an interior and an underside;

a base secured to the underside of the upper;

a bladder mounted within the interior of the upper, the bladder defining a support chamber, a reservoir chamber and a passageway placing the support chamber in fluid communication with the reservoir chamber, the bladder including a pliant wall forming at least a portion of the support chamber, the support chamber being disposed adjacent an anatomic feature of the received foot to be supported;

a plastic material received within at least the support chamber of the bladder and that is deformable via the pliant wall to conform to the anatomic feature, the plastic material having, a viscosity that increases to stiffen the plastic material in response to warming of the plastic material from an ambient temperature to an elevated temperature upon heat transfer from the received foot, the plastic material and the passageway being configured so that the plastic material flows through the passageway into the reservoir chamber at the ambient temperature and is substantially inhibited from flowing through the passageway at the elevated temperature, the plastic material being substantially static and retained in the support chamber during use at or above the elevated temperature; and reverse flow means acting on the bladder for urging the plastic material to return from the reservoir chamber to the support chamber when the plastic material cools to the ambient temperature after use.

2. The sport shoe of claim 1, wherein the plastic material comprises a reverse thermal gel.

3. The sport shoe of claim 1, wherein the passageway has a predetermined length and diameter to substantially inhibit flow of the plastic material through the passage at the elevated temperature during a predetermined period of usage.

4. The sport shoe of claim 1, wherein the reverse flow means comprises a biasing member which exerts a compressive force on the reservoir chamber.

5. The sport shoe of claim 1, wherein the bladder is mounted within the upper such that the reservoir chamber is elevated relative to the support chamber, and wherein the reverse flow means comprises a gravity fed passageway between the reservoir chamber and the support chamber.

6. The sport shoe of claim 1, wherein the bladder is disposed within the interior of the upper such that the received foot exerts a lower pressure on the reservoir chamber relative to a pressure exerted by the received foot on the support chamber.

7. The sport shoe of claim 6, wherein the upper includes an elastomeric support layer received within the interior of the upper and configured to surround the anatomical feature, wherein the support chamber of the bladder is mounted at least partially on an interior side of the elastomeric support layer and the reservoir chamber is mounted at least partially on an exterior side of the elastomeric support layer.

8. The sport shoe of claim 1, wherein the upper includes an ankle portion which surrounds the ankle of the received foot, and wherein the bladder is mounted at least partially within the interior of the ankle support portion to support the malleoli of the user.

9. The sport shoe of claim 8, wherein the bladder is positioned and configured to limit lateral flexure of the received ankle while permitting fore and aft flexure of the received ankle.

10. The sport shoe of claim 9, wherein the sport shoe is configured as an in-line skate shoe, and further comprises a frame secured to an underside of the base for rotatably mounting a plurality of wheels.

11. The sport shoe of claim 8, wherein the bladder is configured and mounted to limit fore and aft flexure of the received ankle while permitting lateral flexure of the received ankle.

12. The sport shoe of claim 1, wherein the support chamber of the bladder is disposed adjacent the metatarsal head area of the received foot.

13. The sport shoe of claim 1, wherein the support chamber of the bladder is disposed adjacent the heel of the received foot.

14. The sport shoe of claim 1, further comprising:

a rigid support connected to the base and extending upwardly to surround at least portions of the upper;

an elastomeric support layer included in the upper and disposed within an interior of the rigid support, wherein at least the support chamber of the bladder is mounted within an interior of the elastomeric support layer.

15. A sport shoe for receiving and supporting a user's foot, comprising:

an upper adapted to receive a user's foot, the upper defining an interior and an underside;

a base secured to the underside of the upper;

a bladder mounted within the interior of the upper, the bladder defining a support chamber, a reservoir chamber and a temperature responsive valve placing the support chamber in fluid communication with the reservoir chamber, the bladder including a pliant wall forming at least a portion of the support chamber, the support chamber being disposed within the interior of the upper adjacent, and pressured by, an anatomic feature of the received foot to be supported, and the reservoir chamber being disposed in a portion of the upper subjected to lower foot pressure; and a plastic material received within at least the support chamber of the bladder and that is deformable via the pliant wall to conform to the anatomic feature, the temperature responsive valve permitting the plastic material to flow through the valve into the reservoir chamber at an ambient temperature for adjustment of the volume of plastic material within the support chamber when the foot is initially received within the upper, the temperature responsive valve substantially inhibiting the plastic material from flowing through the valve at an elevated temperature upon warming of the interior of the upper due to heat transfer from the received foot, the plastic material being stiffened and substantially static and retained in the support chamber during use at or above the elevated temperature.

16. A sport shoe for receiving and supporting a user's foot, comprising:

an upper adapted to receive a user's foot, the upper defining an interior and an underside;

a base secured to the underside of the upper;

a bladder mounted within the interior of the upper, the bladder defining a support chamber, a reservoir chamber and a passageway placing the support chamber in fluid communication with the reservoir chamber, the bladder including a pliant wall forming at least a portion of the support chamber, the support chamber being disposed adjacent an anatomic feature of the received foot to be supported;

a plastic material received within at least the support chamber of the bladder and that is deformable via the pliant wall to conform to the anatomic feature, the plastic material having a viscosity that increases to stiffen the plastic material in response to warming of the plastic material from an ambient temperature to an elevated temperature upon heat transfer from the received foot, the plastic material and the passageway being configured so that the plastic material flows through the passageway into the reservoir chamber at the ambient temperature and is substantially inhibited from flowing through the passageway at the elevated temperature, the plastic material being substantially static and retained in the support chamber during use at or above the elevated temperature; and a biasing membrane acting on the reservoir chamber for urging the plastic material to return from the reservoir chamber to the support chamber when the plastic material cools to the ambient temperature after use.

17. A roller skate including an upper shoe portion that receives and supports a user's foot and ankle, and a plurality of wheels, the roller skate comprising:

a frame for rotatably mounting the plurality of wheels, the frame defining an upper side;

an upper secured to the upper side of the frame and adapted to receive a user's foot and ankle;

a rigid support connected to the frame and extending upwardly therefrom to at least partially surround the received ankle, the rigid support defining an interior;

a bladder mounted within the interior of the rigid support and including a pliant wall disposed adjacent the received ankle; and a plastic material received within the bladder and that is deformable via the pliant wall to conform to the ankle joint, the plastic material having a viscosity that increases to stiffen the plastic material in response to warming of the plastic material from an ambient temperature to an elevated temperature due to heat transfer from the received foot and ankle, for substantially static retention of the plastic material in the bladder to provide increased support of the ankle at the elevated temperature to limit lateral flexure of the ankle.

18. The roller skate of claim 17, further comprising an elastomeric support layer mounted within the interior of the rigid support and disposed between the rigid support and the bladder.

19. The roller skate of claim 18, wherein the elastomeric support layer is formed of a continuous portion of the upper.

20. The roller skate of claim 18, wherein the upper includes an outer fabric, the rigid support extending upwardly from the frame between the outer fabric of the upper and the elastomeric support layer of the upper.

21. The roller skate of claim 18, wherein the elastomeric support layer surrounds the received ankle and includes first and second recesses corresponding to the malleoli, the bladder being received within at least one of the first and second recesses.

22. The roller skate of claim 21, wherein the bladder is adhered within the recess in which the bladder is received.

23. The roller skate of claim 21, wherein the rigid support surrounds the malleoli of the received ankle, and includes first and second recesses contoured to conform to the received malleoli.

24. The roller skate of claim 18, wherein the elastomeric support layer is a molded elastomer and wherein the bladder is at least partially internally molded within the elastomeric support layer.

25. A sport shoe including an upper shoe portion that receives and supports a user's foot and ankle, the sport shoe comprising:

a base defining an upper side;

an upper secured to the upper side of the base and adapted to receive a user's foot and ankle;

a rigid support connected to the base and extending upwardly therefrom to at least partially surround the received ankle, the rigid support defining an interior;

a bladder mounted within the interior of the rigid support and including a pliant wall disposed adjacent the received ankle; and a plastic material received within the bladder and that is deformable via the pliant wall to conform to the ankle joint, the plastic material having a viscosity that increases to stiffen the plastic material in response to warming of the plastic material from an ambient temperature to an elevated temperature due to heat transfer from the received foot and ankle, for substantially static retention of the plastic material in the bladder to provide increased support of the ankle at the elevated temperature to limit lateral flexure of the ankle.

26. A sport shoe for receiving and supporting a user's foot, comprising:

a base;

an upper adapted to receive a user's foot, the upper defining an interior and an underside secured to the base;

a molded elastomeric support layer received within the interior of the upper and configured to surround an anatomic feature of the received foot;

a bladder at least partially internally molded within the elastomeric support layer and including a pliant wall disposed towards the anatomic feature of the received foot; and a plastic material received within the bladder and that is deformable via the pliant wall to conform to the anatomic feature, the plastic material having a viscosity that increases in response to warming of the plastic material from an ambient temperature due to heat transfer from the received foot, for increased support of the anatomic feature.

27. The sport shoe of claim 25, wherein the sport shoe is configured as an in-line skate shoe, and the upper and the molded elastomeric support layer extend to surround the user's ankle, further comprising a frame secured to an underside of the base for mounting a plurality of wheels.

28. The sport shoe of claim 27, wherein the bladder is mounted adjacent the received ankle.

* * * * *